US005689205A

United States Patent [19]

Hughes et al.

[11] Patent Number: 5,689,205

[45] Date of Patent: Nov. 18, 1997

[54] SWITCHED CURRENT DIFFERENTIATOR

[75] Inventors: John B. Hughes, Hove; Kenneth W. Moulding, Horley, both of England

[73] Assignee: U.S. Philips Corporation, New York, N.Y.

[21] Appl. No.: 586,445

[22] Filed: Jan. 11, 1996

[30] Foreign Application Priority Data

Jan. 13, 1995 [GB] United Kingdom ..... 9500648

[51] Int. Cl.[6] ..... G06G 7/18

[52] U.S. Cl. ..... 327/335; 327/339

[58] Field of Search ..... 327/335, 334, 327/336, 337, 339, 91

[56] References Cited

U.S. PATENT DOCUMENTS

| | | | |
|---|---|---|---|
| 4,866,368 | 9/1989 | Bird | 327/91 |
| 5,012,133 | 4/1991 | Hughes | 327/91 |
| 5,023,489 | 6/1991 | Macbeth | 327/91 |
| 5,097,155 | 3/1992 | Liu et al. | 327/335 |
| 5,109,169 | 4/1992 | Hughes | 327/91 |
| 5,179,301 | 1/1993 | Hughes | 327/335 |
| 5,296,752 | 3/1994 | Goenenveld et al. | 327/91 |
| 5,349,245 | 9/1994 | Hughes et al. | 327/91 |
| 5,400,273 | 3/1995 | Hughes et al. | 365/45 |
| 5,473,275 | 12/1995 | Hughes et al. | 327/336 |

FOREIGN PATENT DOCUMENTS

| | | | |
|---|---|---|---|
| 0416699A1 | 3/1991 | European Pat. Off. | G06G 7/18 |
| 0608936A2 | 3/1994 | European Pat. Off. | G11C 27/02 |
| 0642095A2 | 3/1995 | European Pat. Off. | G08G 7/186 |

*Primary Examiner*—Timothy P. Callahan
*Assistant Examiner*—Terry L. Englund

[57] ABSTRACT

A switched current differentiator includes first and second interconnected current memory cells. An input current is applied to terminal (1) and is fed on line (2) to the current memory cells. A first output current is derived from the first current memory cell via a transistor and a second output current is derived from the second current memory cell via another transistor. The second output current is inverted (A1) and summed with the first output current. The summed current is inverted (A2) and fed to an output via a switch on odd phases of a clock signal and is fed directly to the output via a further switch (S4) on even phases of a clock signal. A damped differentiator may be formed using a feeback loop. In a fully differential version of the differentiator the inverters may be constructed by the correct interconnection of the differential signals, i.e. by crossing over connections.

18 Claims, 4 Drawing Sheets

SWITCHED CURRENT DIFFERENTIATOR

Figure 1:
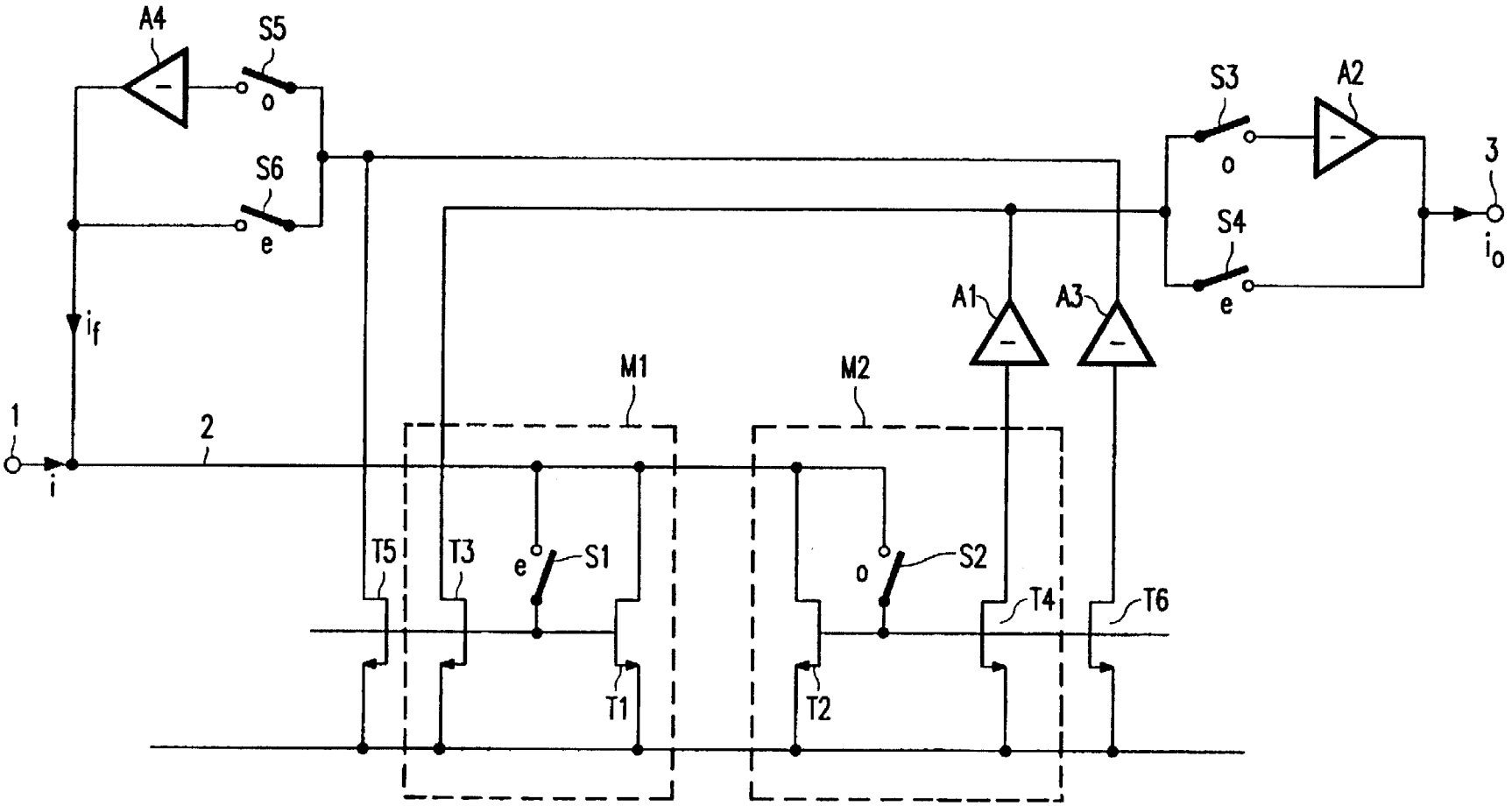

The invention relates to a switched current bilinear differentiator. Differentiators are of general interest as an alternative to integrators for the implementation of active ladder filters or filters using biquadratic sections. Further even when integrators are used in biquadratic sections the cascaded sections frequently require a differentiated input and while there are known methods for producing from integrator outputs they must be generated explicitly for the first section. A switched current differentiator has been disclosed in EP-A-0 416 699 (PHB 33584). However this circuit requires a unity gain positive amplifier which is difficult to create with sufficient accuracy and is thus a rather complex solution.

It is an object of the invention to enable the provision of a switched current differentiator which performs with a bilinear mapping but which does not require the presence of a unity gain positive amplifier.

The invention provides a switched current bilinear differentiator comprising first and second interconnected current memory cells, means for feeding an input current to be differentiated to the input of the current memory cells, said first current memory cell being arranged to sample the current at its input during a first period of a clock signal, said second current memory cell being arranged to sample the current at its input during a second period of the clock signal, means for summing a first current related to that in the first current memory cell and second current being an inverted version of a current related to that in the second current memory cell, means for connecting the summed current to an output during the first period of the clock signal and means for feeding an inverted version of the summed signal to the output during a second period of the clock signal; wherein the current at said output is the differentiated current.

The differentiator may comprise a feedback loop for feeding back a current related to the output current to the input of the differentiator.

This enables a damped (lossy) differentiator to be realised.

The feedback loop may comprise means for generating a third current related to that in the first current memory cell, means for generating a fourth current, said fourth current being an inverted version of a current related to that in the second current memory cell, means for summing the third and fourth currents, means for feeding the summed current to the input of the current memory cells during the first period of the clock signal, and means for feeding an inverted version of the summed current to the input of the current memory cells during a second period of the clock signal.

This provides a convenient way of producing a scaled replica of the output current for feeding back to the input.

The first and second currents and/or the third and fourth currents may be derived from those in the first and second current memory cells by means of current mirror arrangements.

The differentiator may have differential inputs and outputs and comprise first and second differential current memory cells in which the necessary current inversions are effected by appropriate interconnection of the differential outputs of the current memory cells and/or the means for generating output currents related to those in the current memory cells.

This enables the current inverters to be replaced by appropriate selection and combination of the differential outputs. Thus a current inversion is obtained merely by swapping the senses of the differential currents at the various nodes within the arrangement.

The current memory cells may be arranged to sense and store the currents at these inputs using a coarse and fine step. Such current memory cells are disclosed in EP-A-0 608 936 (PHB 33830), the contents of which are hereby incorporated by reference, to which reference may be made for a more detailed description of its construction and operation than that given with reference to FIGS. 3 and 4 of the present application.

Figure 2:
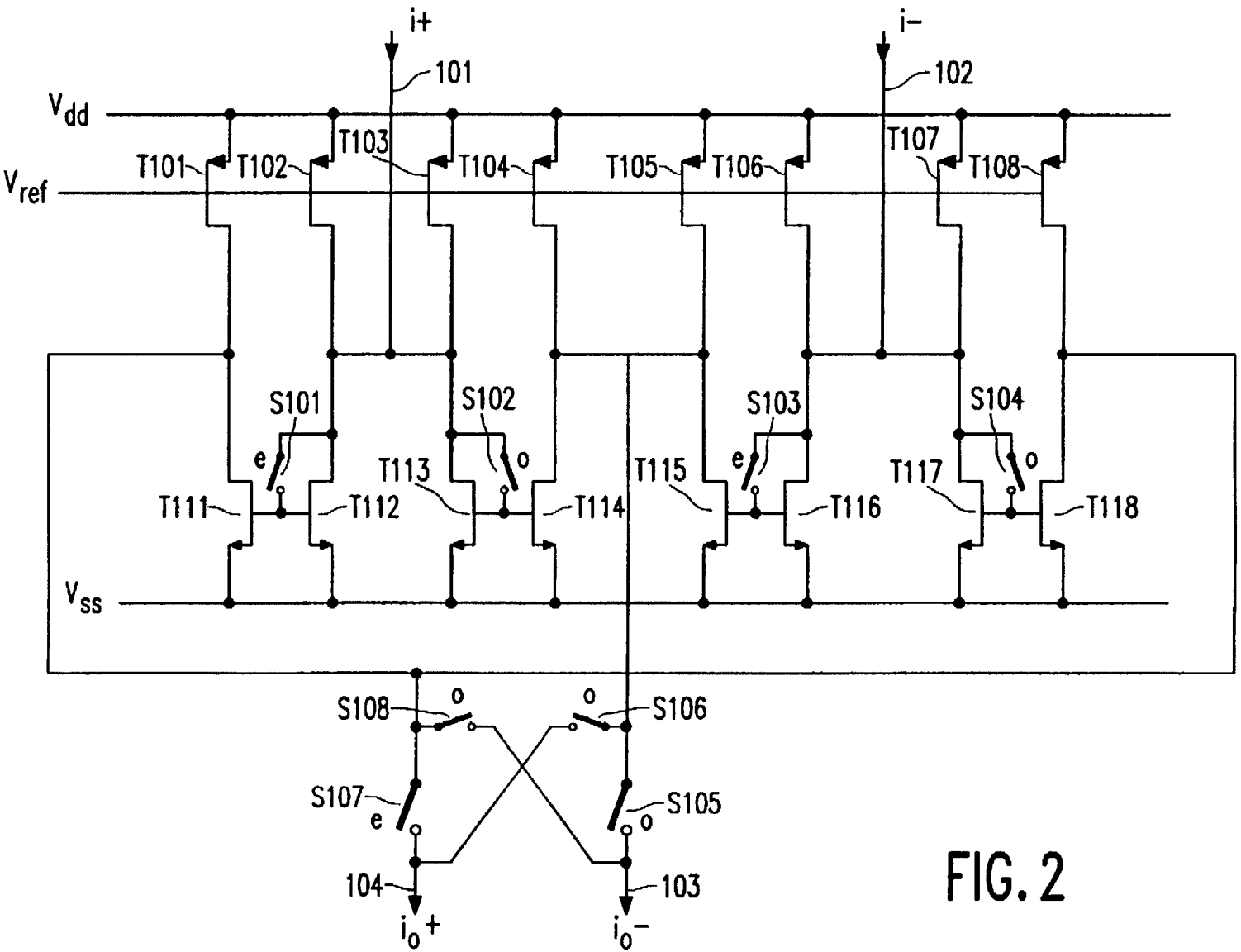
Figure 3:
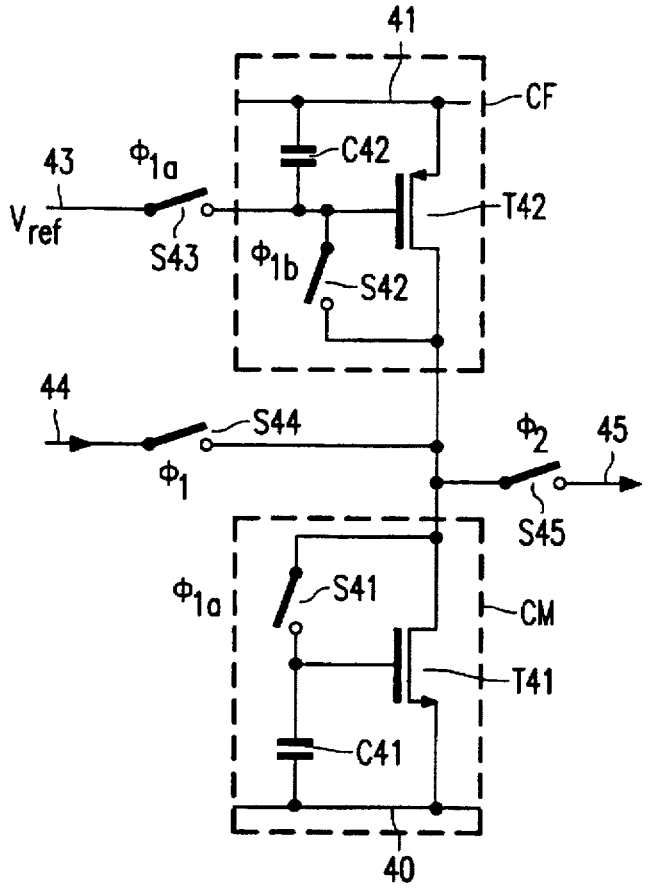
Figure 4:
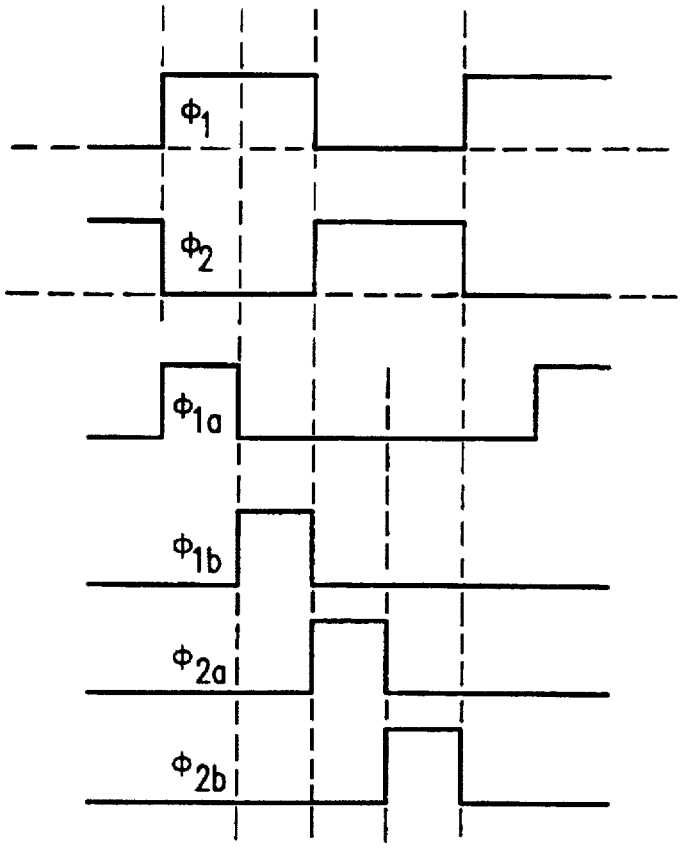
Figure 5:
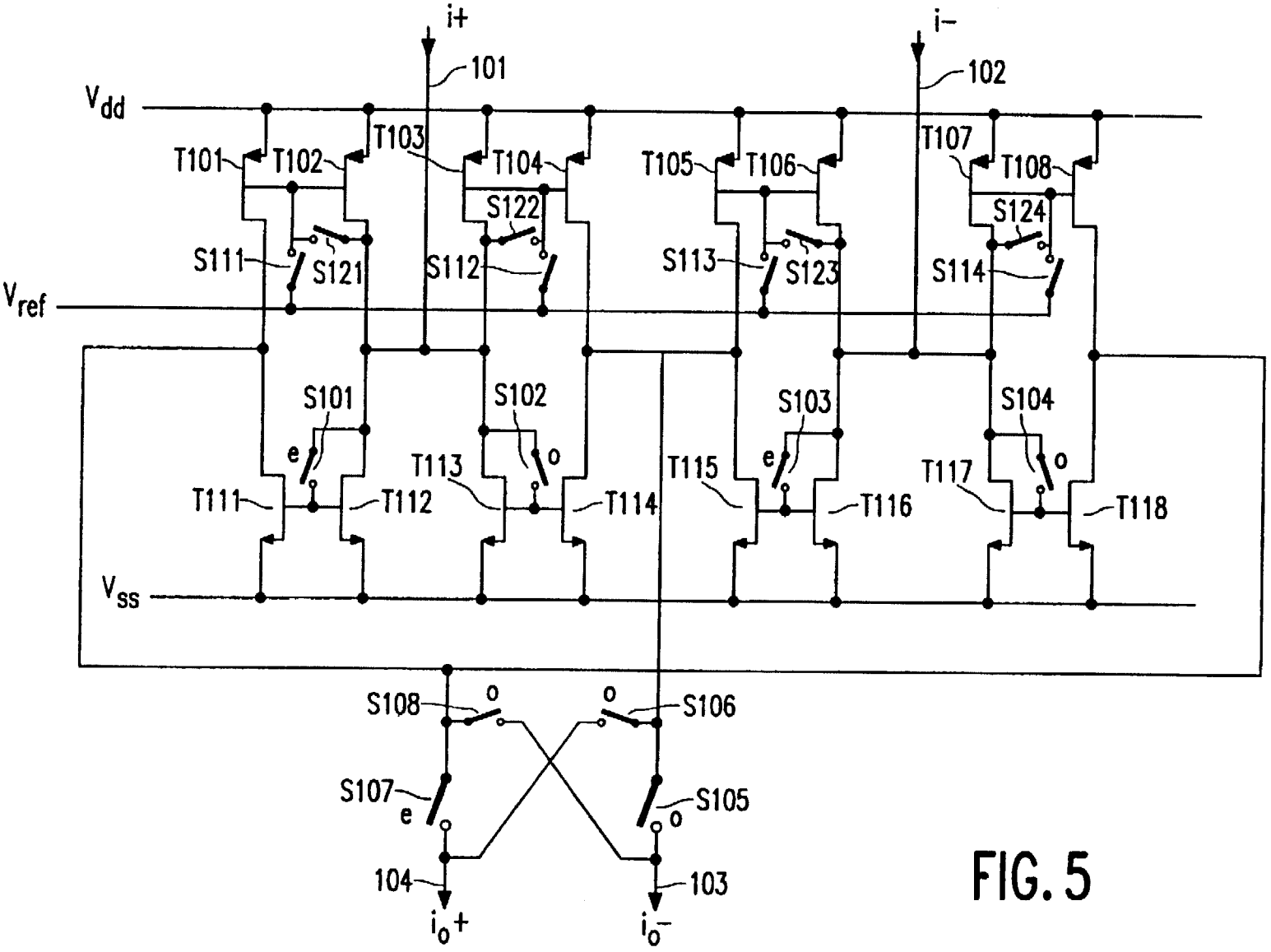

Embodiments of the invention will now be described, by way of example with reference to the accompanying drawings, in which:

FIG. 1 shows in schematic form a bilinear z transform differentiator according to the invention, FIG. 2 shows a balanced version of the differentiator shown in FIG. 1, FIG. 3 shows a two step current memory cell which may be used in the differentiator of FIG. 1 or FIG. 2, FIG. 4 shows clockwave forms associated with the current memory shown in FIG. 3, and FIG. 5 shows a bilinear z transform differentiator using the current memory cell shown in FIG. 3.

FIG. 1 shows in schematic form a bilinear z transform differentiator according to the invention. It is purely a schematic diagram and does not include bias currents which would normally as is well known be included in practice to enable bidirectional currents to be handled and includes current inverters to invert the signal currents. These current inverters are present for ease of understanding and are not required in a fully differential structure as will be explained hereinafter.

As shown in FIG. 1 an input 1 is connected over a line 2 to the drain electrodes of first and second n channel field effect transistors T1, and T2. The drain electrode of transistor T1 is connected by a switch S1 to its gate electrode while the drain electrode of transistor T2 is connected by a switch S2 to its gate electrode. Transistor T1 and switch S1 form a first current memory cell M1 whilst transistor T2 and switch S2 form a second current memory cell M2. The current memory cell M1 further comprises a second transistor T3 which has its gate electrode connected to the gate electrode of transistor T1 and whose drain electrode is connected to one side of two switches S3 and S4. Similarly the current memory cell M2 comprises a further transistor T4 whose gate electrode is connected to the gate electrode of transistor T2 and whose drain electrode is connected by a unity gain inverting amplifier A1 to the junction of switches S3 and S4. The source electrodes of transistors T1 to T4 are all connected to a common supply rail. Consequently the current in transistor in T3 mirrors that in transistor T1 when switch S1 is closed, and the current in transistor T4 mirrors that in transistor T2 when switch S2 is closed. The junction of switches S3 and S4 forms a summing node where the currents from transistors T3 and T4 are summed. The other side of switch S4 is connected to an output 3 while the other side of switch S3 is connected via a unity gain inverting amplifier A2 to the output 3. The switches S1 and S4 are closed during an even period of the clock while the switches S2 and S3 are closed during an odd period.

The operation of the circuit shown in FIG. 1 can be summarised as follows:

Following an even period the current stored in the left hand memory cell M1 as a result of the charge on the gate-source capacitance of transistor T1 is increased by the change in the input current from the previous (odd period). Similarly the current stored in the right hand memory cell following an odd period is increased by the change in input current from the previous even (period). The stored currents are mirrored and subtracted and then inverted on odd periods to produce the output current. The analysis which follows shows that the circuit performs undamped differentiation according to the bilinear s-z transformation.

odd phase i.e. (n−1)

$i_2(n-1)=i(n-1)-i_1(n-1)$ $i_o(n-1)=\alpha\{i_1(n-1)-i_2(n-1)\}$ where i is the input current, $i_1$ is the current in transistor T1, $i_2$ is the current in transistor T2, $i_o$ is the output current, and α is the ratio of transistor T1 to transistor T3 and of transistor T2 to transistor T4.

Even phase i.e. (n)

$$\begin{aligned}
& i_1(n) = i(n) - i_2(n) \\
& \text{but } i_2(n) = i_2(n-1) \\
& \therefore\ i_1(n) = i(n) - i(n-1) + i_1(n-1) \\
\text{output, } i_o(n) &= -\alpha\{i_1(n) - i_2(n)\} \\
&= -\alpha\{i(n) - i(n-1) + i_1(n-1) - i_2(n-1)\} \\
& \text{but } i_o(n-1) = \alpha\{i_1(n-1) - i_2(n-1)\} \\
& \therefore\ i_o(n) = -\alpha\{i(n) - i(n-1)\} - i_o(n-1) \\
& \therefore\ i_o(n) + i_o(n-1) = -\alpha\{i(n) - i(n-1)\}
\end{aligned}$$

In the z domain:

$$i_o(z)(1+z^{-1}) = ai(z)(1+z^{-1}) \tag{1}$$

$$\therefore H(z) = \frac{i_o}{i}(z) = \alpha\frac{1-z^{-1}}{1+z^{-1}} \quad \text{(even)}$$

For the next odd phase (n+1l)

$$\begin{aligned}
& i_2(n+1) = i(n+1) - i_1(n+1) \\
& \text{and } i_1(n+1) = i_1(n) \\
& \therefore\ i_2(n+1) = i(n+1) - i_1(n) \\
& \qquad = i(n+1) - i(n) + i_2(n) \\
i_o(n+1) &= \alpha\{i_1(n+1) - i_2(n+1)\} \\
&= \alpha\{i_1(n) - i_2(n+1)\} \\
&= \alpha\{i_1(n) - i(n+1) + i(n) - i_2(n)\} \\
&= \alpha\{i(n+1) - i(n)\} + \alpha\{i_1(n) - i_2(n)\} \\
&= -\alpha\{i(n+1) - i(n)\} - i_0(n) \\
& \therefore\ i_o(n+1) + i_o(n) = -\alpha\{i(n+1) - i(n)\}
\end{aligned}$$

$$\therefore H(z) = \frac{i_o(z)}{i(z)} = -\alpha\frac{1-z^{-1}}{1+z^{-1}} \text{ – same as even phase} \tag{2}$$

From (1) and (2), the z domain response is the same for both odd and even phases.

The bilinear z—transform is $$S = \frac{2}{1}\ \frac{1-z^{-1}}{1+z^{-1}} \tag{3}$$

So, $$H(S) = -a\frac{T}{2}\cdot S$$

which describes an ideal (undamped) differentiator.

In order to produce a damped differentiator the circuit described so far has the following additions.

In order to produce a damped (lossy) differentiator an additional feedback loop is included. To produce this feedback loop an n-channel field effect transistor T5 has its gate electrode connected to the gate electrode of transistor T1, its source electrode connected to the common supply rail, and its drain electrode connected to the junction of two switches S5 and S6. A further n-channel field effect transistor T6 has its gate electrode connected to the gate electrode of transistor T2, its source electrode connected to the common supply rail, and its drain electrode connected by means of an inverting amplifier A3 to the junction of switches S5 and S6. The other side of switch S5 is connected via an inverting amplifier A4 to the line 2 while the other side of switch S6 is directly connected to the line 2.

It can be seen that this provides a feedback signal to line 2 which is of the same form as the output signal at output 3. The feedback factor which determines the damping of the differentiator characteristic is controlled by appropriately choosing the geometry of transistors T5 and T6 relative to that of transistors T1 and T2. Similarly the overall gain of the differentiator is determined by the geometry of transistors T3 and T4 relative to that of transistors T1 and T2.

It can be shown by standard circuit analysis that the response of the arrangement shown in FIG. 1 is given by $$\begin{aligned}
H(z) &= \frac{-\alpha(1-z^{-1})}{1+z^{-1}+\alpha f(1-z^{-1})} \\
&= -\alpha\cdot\frac{1-z^{-1}}{1+\alpha f+(1-\alpha f)z^{-1}} \\
&= -\left(\frac{\alpha}{1+\alpha f}\right)\cdot\frac{1-z^{-1}}{1+\left(\frac{1-\alpha f}{1+\alpha f}\right)z^{-1}}
\end{aligned}$$

which is the expression for damped differentiation:

where α is the ratio of transistors T1 and T2 to transistors T3 and T4 $\alpha_f$ is the ratio of transistors T1 and T2 to transistors T5 and T6.

FIG. 2 shows a fully differential version of a bilinear z-transform differentiator which performs the same algorithm as expressed in the analysis of the circuit of FIG. 1 but with signal current inversions achieved simply by crossing over the signal pairs. The p-channel MOS transistors T101 to T108 have their source electrodes connected to a positive supply rail $V_{dd}$ and their gate electrodes connected to a reference voltage $V_{ref}$. As is well known in switched current circuits each of these transistors forms a constant current source which produces a bias current to enable bidirectional input signals to be handled. A differential input current i is fed on input lines 101 and 102. The line 101 is connected to the junction of the drain electrodes of transistors T102 and T103 while the line 102 is connected to the junction of the drain electrodes of transistors T106 and T107. The drain electrodes of transistors T101 to T108 are connected to the drain electrodes of N-channel MOS transistors T111 to T118 respectively. The source electrodes of transistors T111 to T118 are connected to a negative supply rail $V_{ss}$. A switch S101 is connected between the drain electrode of transistor T112 and its gate electrode. Similarly, a switch S102 is connected between the drain and gate electrodes of transistor T113, a switch S103 is connected between the drain and gate electrodes of transistor T116, and a switch S104 is connected between the drain and gate electrodes of transistor T117. The gate electrode of transistor T111 is connected to the gate electrode of transistor T112, the gate electrode of T113 is connected to the gate electrode T114, the gate electrode of transistor T115 is connected to the gate electrode of transistor T116, and the gate electrode of transistor T117 is connected to gate electrode of T118. The drain electrode of transistor T112 is connected to the drain electrode of transistor T113. The drain electrode of transistor T114 is connected to the drain electrode of transistor T115, the drain electrode of transistor T116 is connected the drain electrode of transistor T117 and the drain electrode of transistor T118 is connected to the drain electrode of transistor T111. The junction of the drain electrodes of transistors T114 and T115 are connected via a first switch S105 to an output line 103 and via switch S106 to an output line 104. The junction of the drain electrodes of transistors T111 and T118 is connected to the output 104 via a switch S107 and to the output 103 via a switch S108.

The transistors T112 and T116 together with the switches S101 and S103 form a differential version of a current memory cell equivalent to that of the memory cell M1 in FIG. 1. The transistors T111 and T114 produce the second output which is taken from transistor T3 in FIG. 1. Similarly the transistors T113 and T117 and associated switches S102 and S104 form a differential version of the current memory M2 shown in FIG. 1. Transistors T111 and T115 with switches S106 and S107 together with transistors T114 and T118 with switches S105 and S108 produce a differential version of the currents produced by transistors T3 and T4, amplifiers A1 and A2, and switches S3 and S4 shown in FIG. 1. Since the true and inverted versions of the current are always available at the output of the current memory cells M1 and M2 the inversion function can be selected merely by choosing the correct interconnection of the outputs of the current memory cells.

FIG. 3 shows a current memory circuit which is an improvement on the current memory circuit shown in FIG. 1. FIG. 4 shows the various clock wave forms used in the current memory of FIG. 3. The current memory shown in FIG. 3 comprises a first N-channel field effect transistor T41 which has its source electrode connected to a negative supply rail 40 and its drain electrode connected to the drain electrode of the P-channel field effect transistor T42 whose source electrode is connected to a positive supply rail 41. A capacitor C41 is connected between the gate and source electrodes of transistor T41 while a switch S41 is connected between the drain and gate electrodes of transistor T41. Similarly a capacitor C42 is connected between the source and gate electrodes on transistor T42 while a switch S42 is connected between the gate and drain electrodes of transistor T42. An input 44 is connected via a switch S44 to the junction of the drain electrodes of transistors T41 and T42 and an input 43 to which a voltage reference $V_{ref}$ is applied is connected by a switch S43 to the gate electrode of transistor T42. A switch S45 is connected between the junctions of transistors T42 and T41 and output 45. As shown in FIG. 4 there is a master clock which has two phases $\phi 1$ and $\phi 2$. The switch S44 is closed on phase $\phi 1$ while the switch S45 is closed on phase $\phi 2$, that is the input is sampled on phase $\phi 1$ and the output is produced on phase $\phi 2$. In addition there is a double frequency clock which gives phases $\phi 1a$, $\phi 1b$, $\phi 2a$, $\phi 2b$. Switches S41 and S43 are closed during phase $\phi 1a$, while switch S42 is closed during phase $\phi 1b$.

The process of memorising the sampled and held input current i which is applied to input 44 is made in two steps. The first is a coarse step in which the input sample is memorised approximately in a coarse memory CM which comprises transistor T41 switch S41 and capacitor C41. This is followed by a fine step during which the error of the coarse step is derived and memorised in the memory CF which comprises transistor T42 capacitor C42 and switch S42. The output is then delivered in phase $\phi 2$ from both memory cells so that the coarse error is subtracted to leave an accurate replica of the input sample. The input phase $\phi 1$ is divided into two sub-phases $\phi 1a$ and $\phi 1b$, during which the coarse and then the fine memorising steps occur. During phase $\phi 1a$ the transistor T42 has its gate electrode connected to $V_{ref}$ and generates a bias current j. The current in the diode connected transistor T41 is then j+i. At the end of phase $\phi 1a$ the coarse memory switch S41 is opened and the transistor T41 holds a current j+i+Δi. Where Δi is the signal dependent error resulting from all the usual errors associated with the basic switched current memory cell. During phase $\phi 1b$, the transistor T42 is configured as a diode and with the signal current i still flowing at the cells input its drain current settles towards the current j+Δi. At the end of phase $\phi 1b$, since Δi is very much less than j the voltage at the two transistor drains is close to the value with no signal present, that is the circuit develops a voltage at the drain electrodes of both memory transistors which is akin to a virtual earth.

During phase $\phi 2$ the gate of transistor T42 is opened and an error Si occurs in the fine memory mainly due to charge injection. If the output is fed to a second cell of a similar type the second cell establishes a similar virtual earth at its input during the input phase $\phi 2b$. The drains of the first cells memory are therefore held at nearly the same voltage at the end of both input and output phases, a condition established by negative feedback in conventional cells and which gives a much reduced conductance ratio error. Further because the current in the fine memory transistor and the voltage on its switch are similarly constant during these phases the charge injection error of the fine memory is much reduced.

Even though the clock phases $\phi 1$ and $\phi 2$ are sub divided into a and b sub-phases this does not double the required transistor bandwidths as the settling error on the a sub-phase is transmitted to the transistor T42 where settling may continue on the b sub-phase.

FIG. 5 shows a bilinear differentiator of essentially the same form as that shown in FIG. 2 but using the improved memory cell shown in FIG. 3 rather than the basic memory cell. Elements in FIG. 5 corresponding to those in FIG. 2 have been given the same reference signs. The following description highlights only the differences between this embodiment and that shown in FIG. 2.

In order to form the $S^2I$ current memory cells the direct connection to the gate electrodes of transistors T101 to T108 of the reference voltage $V_{ref}$ is replaced by a switched connection and the switches S101 to S104 are controlled by the waveforms $\phi 1a$ and $\phi 2a$. The reference voltage $V_{ref}$ is applied to the gate electrodes of transistors T101 and T102 via a switch S111, to the gate electrodes of transistors T103 and T104 via a switch S112, to the gate electrodes of transistors T105 and T106 via a switch S113, and to the gate electrodes of transistors T107 and T108 via a switch S114. The gate electrode of transistor T102 is connected to its drain electrode via a switch S121, the gate electrode of transistor T103 is connected to its drain electrode via switch S122, the gate electrode of transistor T106 is connected to its drain electrode via a switch S123, and the gate electrode of transistor T107 is connected to its drain electrode via a switch S124.

The switches are controlled by the clock waveforms shown in FIG. 4. Switches S106 and S108 are closed when $\phi 1$ is high, switches S105 and S107 are closed when $\phi 2$ is high, switches S102, S112, S104 and S114 are closed when $\phi 1a$ is high, switches S122 and S124 are closed when $\phi 1b$ is high, switches S101, S111, S103 and S113 are closed when $\phi 2a$ is high, and switches S121 and S123 are closed when $\phi 2b$ is high.

The operation of the differentiator shown in FIG. 5 is basically the same as that of the differentiator shown in FIG. 2, the only differences being as a result of the modified memory cells. These result in the provision of the double frequency clocks $\phi 1a$ and $\phi 1b$ and $\phi 2a$ and $\phi 2b$.

Both the embodiments of FIGS. 2 and 5 could be further modified to produce lossy (or damped) differentiators by the provision.

From reading the present disclosure, other modifications will be apparent to persons skilled in the art. Such modifications may involve other features which are already known in the design and use of electrical or electronic circuits and component parts thereof and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation of one or more of those features which would be obvious to persons skilled in the art, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

We claim:

1. A switched current bilinear differentiator comprising:

a first current memory cell having an input for receiving a current signal, and an output, said first current memory cell being arranged to sample the current at its input during a first period of a clock signal;

a second current memory cell interconnected with said first current memory and having an input for receiving said current signal, and an output, said second current memory cell being arranged to sample the current at its input during a second period of said clock signal;

means for feeding an input current to be differentiated to said inputs of said current memory cells as the current signal;

summing means having inputs connected to said outputs of said current memory cells for summing a first current related to the sampled current in said first current memory cell and a second current being an inverted version of the current related to the sampled current in said second current memory cell, said summing means having an output for providing a summed current signal;

connection means for connecting the summed current signal to an output of the differentiator during the first period of the clock signal; and inversion means for feeding an inverted version of the summed current signal to the differentiator output during a second period of the clock signal, wherein the current at said output is the differentiated current.

2. The differentiator as claimed in claim 1, wherein said first and second current memory cells further comprise differential current memory cells having differential inputs and outputs, and wherein said inversion means comprises appropriate interconnection of said differential outputs of said current memory cells.

3. A differentiator as claimed in claim 1, wherein said first and second current memory cells are arranged to sense and store the currents at their inputs using a coarse step and a fine step.

4. A differentiator as claimed in claim 1 comprising a feedback loop for feeding back a current related to the differentiated output current to the input of the differentiator.

5. A differentiator as claimed in claim 4 in which said feedback loop comprises means for generating a third current related to that in the first current memory cell, means for generating a fourth current, said fourth current being an inverted version of a current related to that in the second current memory cell, means for summing the third and fourth currents, means for feeding the summed current to the input of the current memory cells during the first period of the clock signal, and means for feeding an inverted version of the summed current to the input of the current memory cells during a second period of the clock signal.

6. A differentiator as claimed in claim 5 in which the first and second currents are derived from currents in the first and second current memory cells by means of current mirror arrangements.

7. A differentiator as claimed in claim 6 in which the third and fourth currents are derived from currents in the first and second current memory cells by means of current mirror arrangements.

8. A differentiator as claimed in claim 5 wherein each current memory cell comprises a field effect transistor having its gate and drain electrodes connected via a switch.

9. A differentiator as claimed in claim 8 in which the third and fourth currents are derived from currents in the first and second current memory cells by means of current mirror arrangements.

10. A differentiator as claimed in claim 1, wherein each current memory cell comprises a field effect transistor having its gate and drain electrodes connected via a switch.

11. A differentiator as claimed in claim 10 in which the first and second currents are derived from currents in the first and second current memory cells by means of current mirror arrangements.

12. A switched current bilinear differentiator comprising;

first and second inputs for receiving a differential input current, first and second outputs for making available a differential output current which represents a differentiated version of the input current;

means for coupling the first input to first and second interconnected current memory cells;

means for coupling the second input to third and fourth interconnected current memory cells;

each of said first and third memory cells being arranged to sample the current at its input during a first period of a clock signal;

each of said second and fourth current memory cells being arranged to sample the current at its input during a second period of the clock signal;

first summing means for summing a first current related to the current in the first current memory cell and a second current related to the current in the fourth current memory cell to form a first summed current;

second summing means for summing a third current related to the current in the second current memory cell and a fourth current related to the current in the third current memory cell to form a second summed current;

means for feeding the first summed current to the first output during the first period of the clock signal and to the second output during the second period of the clock signal; and means for feeding the second summed current to the second output during the first period of the clock signal and to the first output during the second period of the clock signal, wherein the currents at the first and second outputs form the differential current representing the differentiated version of the differential input current.

13. A differentiator as claimed in claim 12, wherein the first, second, third, and fourth currents are derived from currents in the first, second, third, and fourth current memory cells by means of current mirror arrangements.

14. A differentiator as claimed in claim 12 in which the current memory cells are arranged to sense and store the currents at their inputs using a coarse step and a fine step.

15. A differentiator as claimed in claim 12 comprising a feedback loop for feeding back a differential current related to the differential output current to the inputs of the differentiator.

16. A differentiator as claimed in claim 15 comprising means for deriving fifth, sixth, seventh, and eighth currents related to the currents stored in the first, second, third, and fourth current memory cells respectively, third summing means for summing the fifth and eighth currents to form a third summed current, fourth summing means for summing the sixth and seventh currents to form a fourth summed current, means for feeding the third summed current to the first input during the first period of the clock signal and to the second input during the second period of the clock signal, and means for feeding the fourth summed current to the second input during the first period of the clock signal and to the first input during the second period of the clock signal, whereby the differentiated current related to the differential output current is fed to the differential inputs of the differentiator.

17. A differentiator as claimed in claim 16 in which the first, second, third, fourth, fifth, sixth, seventh, and eighth currents are derived from currents in the first, second, third, and fourth current memory cells by means of current minor arrangements.

18. A differentiator as claimed in claim 16 in which the current memory cells are arranged to sense and store the currents at their inputs during a coarse step and a fine step.

* * * * *